United States Patent [19]

Takahashi et al.

[11] Patent Number: 4,960,228

[45] Date of Patent: Oct. 2, 1990

[54] PORTABLE POST-MIX BEVERAGE DISPENSER UNIT

[75] Inventors: Yutaka Takahashi, Fujisawa; Ikuo Harashima, Maebashi; Sunichi Nakayama, Takasaki; Yasuyuki Arai, Isesaki; Yasushi Takayanagi, Sawa; Ryoichi Sekiguchi, Isesaki; Tomomitsu Abe, Hadano; Hiroshi Hayakawa, Yokohama, all of Japan

[73] Assignees: Sanden Corporation, Guma; Kirin Brewery Co., Ltd., Tokyo, both of Japan

[21] Appl. No.: 281,070

[22] Filed: Dec. 8, 1988

[30] Foreign Application Priority Data

Dec. 8, 1987 [JP] Japan ..... 62-308735

[51] Int. Cl.[5] ..... B67D 5/06; B67D 5/56; B67D 5/62

[52] U.S. Cl. ..... 222/129.1; 222/146.6; 222/182; 261/DIG. 7

[58] Field of Search ..... 222/129.1–129.4, 222/132, 145, 146.6, 182; 261/DIG. 7

[56] References Cited

U.S. PATENT DOCUMENTS

| | | | |
|---|---|---|---|
| 3,215,312 | 6/1963 | Guzzi . | |
| 3,348,737 | 10/1967 | Yingst et al. | 222/129.1 |
| 4,059,181 | 11/1977 | Greenfield, Jr. et al. | 222/129.4 |
| 4,304,736 | 12/1981 | McMillin et al. | 222/129.1 |
| 4,493,441 | 1/1985 | Sedam et al. . | |
| 4,496,080 | 1/1985 | Farber et al. | 222/129.3 |
| 4,555,045 | 11/1985 | Rodth et al. . | |
| 4,555,371 | 11/1985 | Jeans | 222/129.1 |
| 4,566,287 | 1/1986 | Schmidt et al. | 222/129.3 |
| 4,635,824 | 1/1987 | Gaunt et al. | 222/129.3 |
| 4,649,809 | 3/1987 | Kanezashi | 222/129.4 |
| 4,688,701 | 8/1987 | Sedam . | |
| 4,703,870 | 11/1987 | Sedam | 222/129.1 |
| 4,804,112 | 2/1989 | Jeans | 222/146.6 |
| 4,815,633 | 3/1989 | Kondo et al. | 222/129.4 |
| 4,836,414 | 6/1989 | Credley, Jr. et al. | 222/129.1 |

FOREIGN PATENT DOCUMENTS

| | | | |
|---|---|---|---|
| 319348 | 1/1989 | European Pat. Off. | 222/129.1 |
| 2133086 | 7/1984 | United Kingdom | 222/129.1 |
| 2152011 | 7/1985 | United Kingdom | 222/129.1 |

*Primary Examiner*—Steven M. Skaggs
*Assistant Examiner*—Steven M. Rein
*Attorney, Agent, or Firm*—Banner, Birch, McKie & Beckett

[57] ABSTRACT

A post-mix beverage dispensing system including a cabinet having top, front, back, side and bottom panels for housing various components is disclosed. The components of the system include a carbonator for producing carbonated water by mixing cooled potable water with $CO_2$. Potable water is stored in a portable tank means and is supplied to the carbonator through a first pipe. The portable tank is easily detachable from the cabinet. The system further includes a cooling reservoir containing cooled water. A serpentine section of the first pipe, along with the carbonator is disposed in the cooling reservoir. A $CO_2$ tank supplies $CO_2$ to the carbonator. Syrup packages dispense a selected syrup. Carbonated water from the carbonator, cool water from the portable tank, and syrup from the syrup packages are mixed in a valve and dispensed through a nozzle. The cooled water may be continuously supplied to the carbonator through the first pipe. Second and third pipes link the carbonator with the valve, and the $CO_2$ to the syrup packages for dispensing $CO_2$ therefrom, respectively.

9 Claims, 5 Drawing Sheets

PORTABLE POST-MIX BEVERAGE DISPENSER UNIT

TECHNICAL FIELD

The present invention relates to compact post-mix beverage dispensers which are portable and suitable for use in small offices or small dispensing volume locations, and more particularly, to a unit which may be disposd on a countertop and which includes a cooling pipe passing through the interior of a cooling reservoir and linked to a closed type portable tank for providing water to be carbonated in the unit.

BACKGROUND OF THE INVENTION

A post-mix beverage dispenser generally includes a cooling reservoir having an evaporator for constantly cooling potable water, as shown in U.S. Pat. No. 4,493,441 which is incorporated by reference. Since the evaporator for cooling potable water is disposed within the cooling reservoir, the cooling reservoir must be fixedly disposed in the interior of the post-mix beverage dispenser. Accordingly, potable water to be mixed is conveyed on the location of the post-mix beverage dispenser and is supplied directly to the cooling reservoir.

The above-discussed post-mix beverage dispenser has several disadvantages. First, a predetermined time must lapse after the potable water is supplied to the cooling reservoir before it is sufficiently cooled. Second, the cooling reservoir is open-type and is not sanitary. Finally, post-mix beverage dispenser cannot be easily connected to an external water supply for automatic refilling of the cooling reservoir.

SUMMARY OF THE INVENTION

It is an object of the invention to provide a portable post-mix beverage dispenser which can continuously supply beverages.

It is another object of the present invention to provide a portable post-mix beverage dispensing unit which is sanitary.

It is still another object of the present invention to provide a portable post-mix beverage dispensing unit which can be easily connected to a building water supply for refilling of the cooling reservoir.

A post-mix beverage dispenser unit according to the present invention comprises a cabinet which has top, front, back, side and bottom panels for housing various components therein. The components of the dispenser include: a carbonator for producing carbonated water by mixing cooled water with $CO_2$, a portable tank to supply potable water to the carbonator, and a cooling reservoir to cool potable water supplied to the carbonator. The portable tank stores the potable water before it is supplied to the carbonator and is easily detachable from the cabinet. Further components include a $CO_2$ tank for supplying $CO_2$ to the carbonator and syrup packages for dispensing a selected syrup. Finally, the unit includes three pipes. The first pipe links the portable tank with the carbonator and includes a serpentine portion disposed in the cooling reservoir to cool water supplied to the carbonator. The second pipe links the $CO_2$ tank with the carbonator. The third pipe links a valve with the carbonator for controlling and dispensing the cabonated water from the carbonator.

Further objects, features and other aspects of this invention will be understood from the line following detailed description of the preferred embodiments of this invention with reference to the drawings.

DETAILED DESCRIPTION OF THE PREFERRED EMBODIMENT

Figure 1:
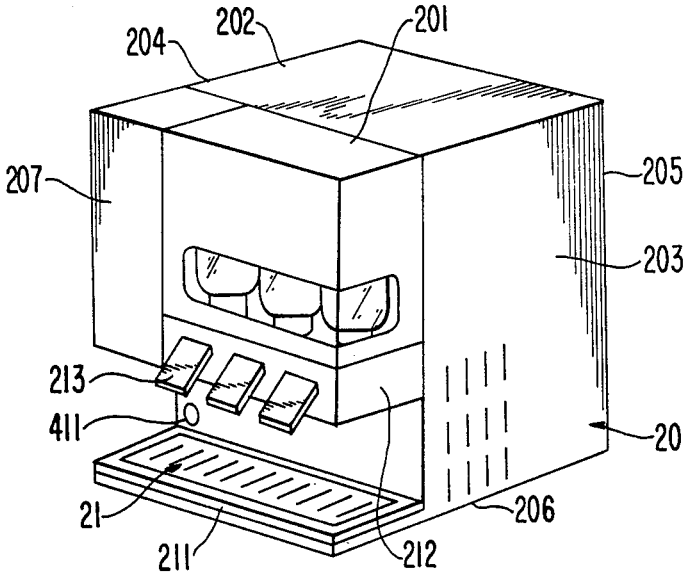
FIG. 1 is a front elevational view of a protable post-mix beverage dispenser unit in accordance with one embodiment of this invention.
Figure 2:
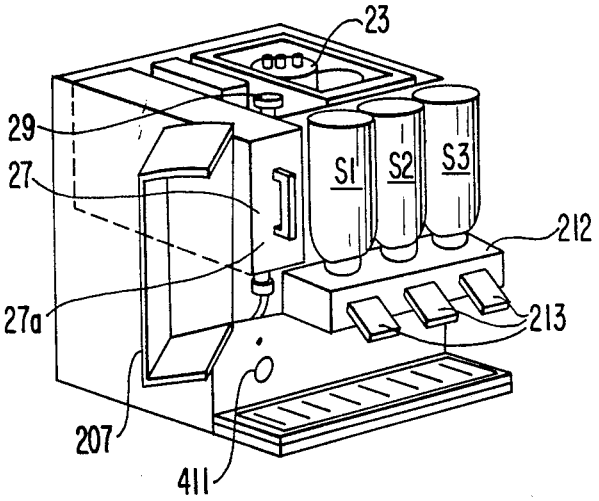
FIG. 2 is a front perspective view of the postable post-mix beverage dispenser unit shown in FIG. 1 with the front access panel and the top access panel removed to illustrate a compartment for the portable tank and the syrup compartment.
Figure 3:
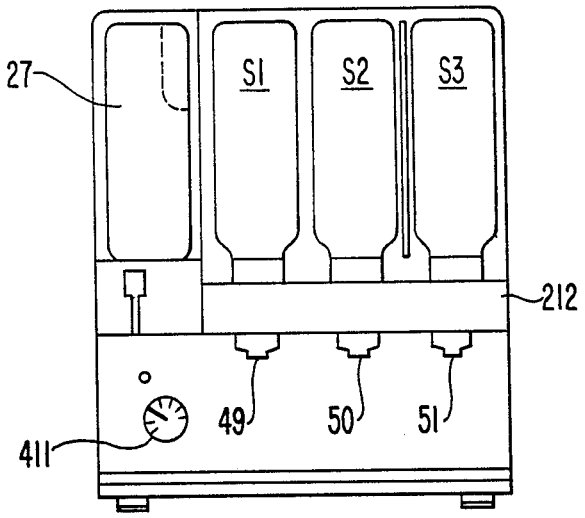
FIG. 3 is a front view of the portable post-mix beverage dispenser unit shown in FIG. 1 with the front access panel and an additional access panel removed to illustrate the portable tank and the syrup supply compartment.

With reference to FIGS. 1–7, a portable post-mix beverage dispenser unit in accordance with the first embodiment of this invention as shown. The unit includes cabinet 20 further including front access panel 201, top access panel 202, right side access panel 203, left side access panel 204, rear side access panel 205, bottom access panel 206 and additional access panel 207. As shown in FIGS. 1 and 2, additional access panel 207 is located adjacent front access panel 201, and is openable by pivoting forwardly about a left side vertical axis. Pouring station 21 is located below front access panel 201 and includes drain plate 211 for receiving cups and for draining liquid spilled from the cups through a plurality of slits. Dispensing portion 212 is located between panel 201 and pouring station 21 and includes valve levers 213 extending downwardly in front. Cooling reservoir 22 is disposed behind panel 201 in one upper corner of cabinet 20 and is covered by an insulating material. Carbonator 23, part of cooling pipe 24, agitator 25, and ice sensor 26 are all disposed within cooling reservoir 22. Reservoir 22 stores cool water which is used for cooling water introduced to cabonator 23 through cooling pipe 24.

Portable tank 27 is removably disposed in an upper left side of cabinet 20 behind panel 207 and next to cooling reservoir 22, and is used to store potable water and to supply potable water, both to be carbonated and to be mixed directly with the syrup. Control box 28, $CO_2$ cylinder or tank 29, and a plurality of syrup packages S1, S2 and S3 located above and connected to dispensing portion 212, are disposed in an upper part of cabinet 20. The syrup packages are disposed within a region defined behind panel 201 and in front of reservoir 22. Cylinder or tank 29 is vertically disposed between portable tank 27 and cooling reservoir 22. Pump 30, compressor 31 and condenser 54 are disposed in a lower part of cabinet 20. Portable tank 27 is linked to pump 30 through sealing coupler 32 and first conduit 33. Sealing coupler 32 connects one end of first conduit 33 to portable tank 27 such that first conduit 33 can be disconnected therefrom without leakage of water. First conduit 33 is further linked with pump 30, and on the other side of pump 30 is linked to cooling pipe 24. Cooling pipe 24 has a rectangular serpentine portion 241 disposed in cooling reservoir 22. The other end of cooling pipe 24 is linked to second conduit 34 and to third conduit 35 through three-way electromagnetic valve 36. Second conduit 34 has check valve 37 and extends to the interior of carbonator 23 located in cooling reservoir 22. Third conduit 35 is divided into three sub-conduits 35*a*, 35*b*, and 35*c*, each sub-conduit coupled with a respective valve V1, V2 or V3 through respective flow control valves 38 disposed in dispensing portion 212.

$CO_2$ cylinder 29 is linked to the interior of carbonator 23 through fourth conduit 39. Check valve 40 and reducing value 41 including pressure gauge 411 are disposed in fourth conduit 39 between cylinder tank 29 and carbonator 23. Carbonated water is produced in carbonator 23 by mixing cooling water from portable tank 27 with $CO_2$ from $CO_2$ cylinder 29.

Fifth conduit 42 is linked to fourth conduit 39 at a location between reducing valve 41 and check valve 40. Fifth conduit 42 includes reducing valve 43 and cock 44. After the location of cock 44, fifth conduit 42 splits into three subconduits 42*a*, 42*b*, and 42*c*, each one having respective check valves 45. Subconduits 42*a*, 42 *b* and 42*c* are linked to syrup package S1, S2 and S3, respectively. Syrup packages S1, S2 and S3 are further linked with valves V1, V2 and V3 respectively through respective flow control valves 46. Reducing valve 43 reduces the pressure of $CO_2$ within fifth conduit 42 to a level of about 0.4 $Kg/Cm^2$.

Carbonator 23 includes cooled carbonated water maintained therein. Sixth conduit 47 extends from near the bottom of carbonator 23 on one end, and is divided into three subconduits 47*a*, 47*b* and 47*c* at the other end. Subconduits 47*a*, 47*b*, and 47*c* are coupled with valves V1, V2 and V3 respectively, through respective flow control valves 48. Valves V1, V2 and V3 are connected at their other ends to nozzles 49, 50, and 51, respectively, to dispense mixed beverages into respective cups 52.

Evaporator 53 is disposed along the outer surface of the inner wall of cooling reservoir 22, and cools the water in cooling reservoir 22. Evaporator 53 forms part of refrigeration circuit also including at least compressor 31 and condenser 54 located externally of cooling reservoir 22 within cabinet 20. The water in reservoir 22 is cooled by evaporator 53 until it is at a temperature of about 0° C.

In operation, a user places a cup on drain plate 211 below a selected one of nozzles 49, 50 or 51 corresponding to a selected beverage. The user then pushes one of valve levers 213 which corresponds to the selected nozzle, simultaneously operating pump 30 and three-way electromagnetic valve 36. Pump 30 pumps water from portable tank 27 through first conduit 33 and into serpentine portion 241 of cooling pipe 24, where it is cooled by the cooling water in reservoir 22. Thereafter, in water flows through three-way electromagnetic valve 36 into carbonator 23 where it is mixed with $CO_2$ from $CO_2$ cylinder 29 to carbonate the water. Float switch 55 controls the volume of carbonated water in carbonator 23. If the level of carbonated water is below a predetermined level, pump 30 operates and more potable water is supplied to carbonator 23 along with $CO_2$ to raise the level of carbonated water back to the predetermined level. The water supplied to carbonator 23 is in the form of mist.

Carbonated water mixed in carbonator 23 flows through sixth conduit 47, and through the appropriate subconduit to respective flow control valve 48. Additionally, potable water is sent directly to one flow control valve 38 in dispensing portion 212 through third conduit 35 and the appropriate subconduit from electromagnetic valve 36. That is, water flows from serpentine portion 241 without passing through carbonator 23. Finally, syrup flows from one of the appropriate syrup packages S1, S2 or S3 to respective flow control valve 46 due to the pressure of the $CO_2$ in conduit 45 and the appropriate subconduit. Tdhe volume of carbonated water, potable water and syrup are controlled at flow control valves 48, 38 or 46 respectively, and is supplied to the associated valve V1, V2 or V3 where they are mixed. The mixed beverages then flows through the associated nozzle 49, 50 or 51 to cup 52.

Figure 4:
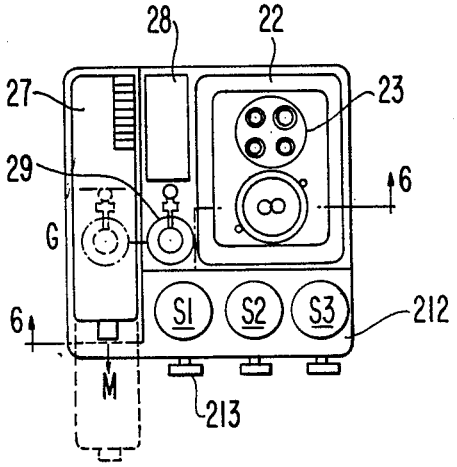
FIG. 4 is a top plane view of the portable post-mix beverage dispenser unit shown in FIG. 1 with the top access panel removed to illustrate the compartments for housing the various respective components.
Figure 5:
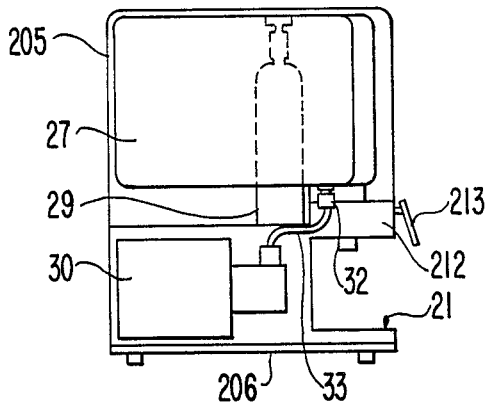
FIG. 5 is a left side elevational view of the portable post-mix beverage dispenser unit shown in FIG. 1 with the left side main cabinet portion removed to illustrate the compartments for housing respective components.
Figure 6:
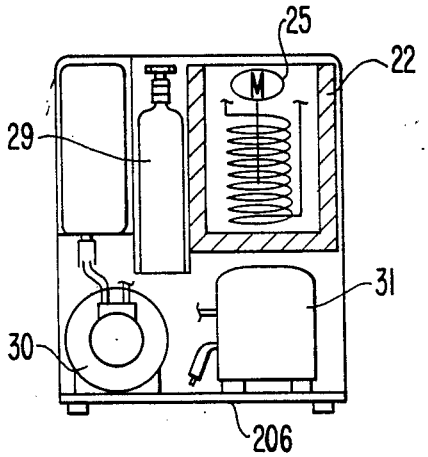
FIG. 6 is a vertical cross-sectional view of the portable post-mix beverage dispenser unit shown in FIG. 1 taken along line V1—V1 in FIG. 4 and illustrating the compartments for housing respective components.
Figure 7:
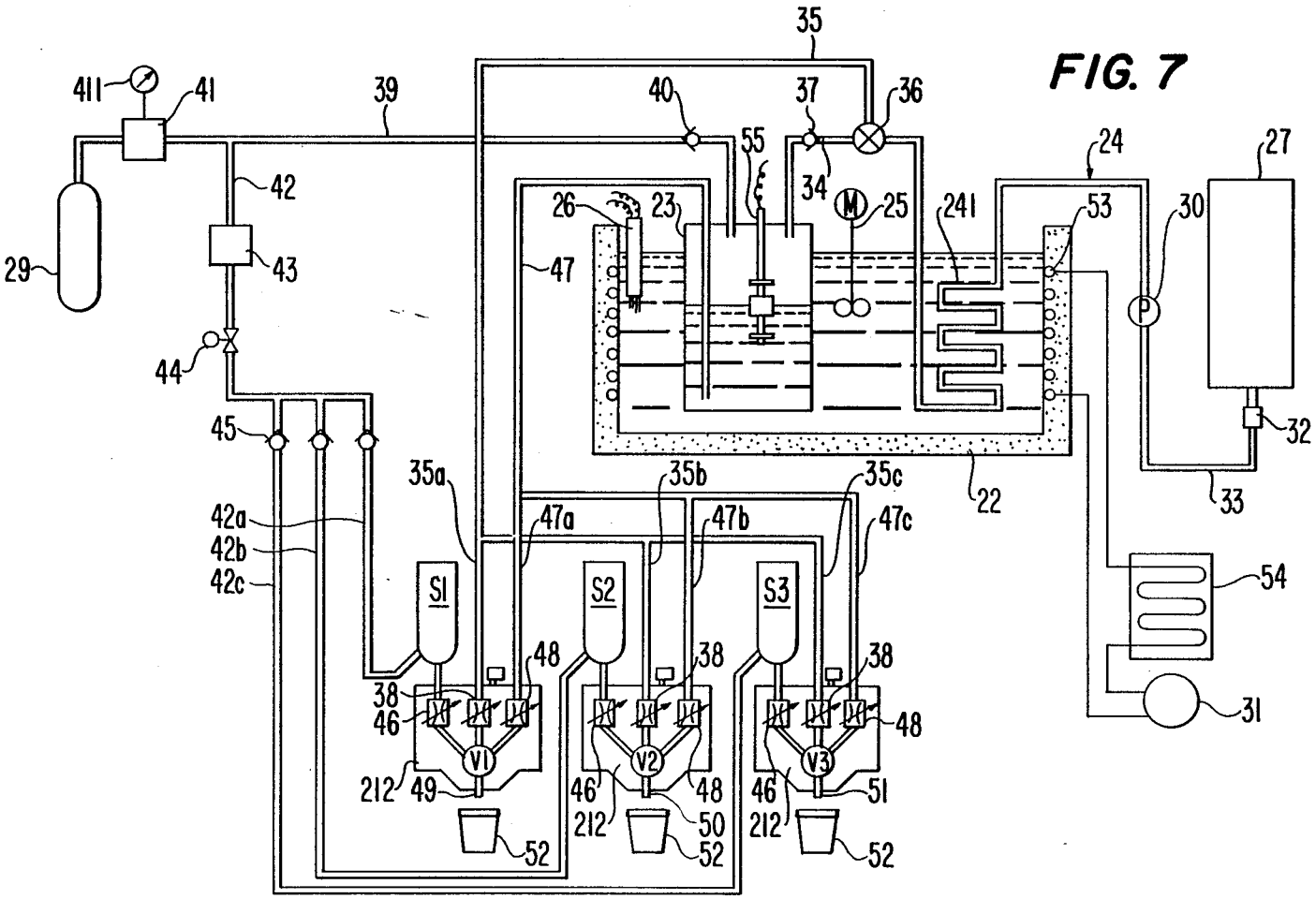
FIG. 7 is a schematic diagram of the mechanical refrigeration system of the portable post-mix beverage dispenser unit shown in FIG. 1.

Since $CO_2$ cylinder 29 and syrup packages S1, S2 and S3 are detachable, when the supply of the contents of the tank or syrup packages is exhausted the tank or package is removed and replaced with a fresh supply. When the supply of potable water in portable tank 27 is exhausted, access panel 207 is opened sealing coupler 32 is detached from portable tank 27 and the tank is removed and refilled with potable water. The portable tank is reattached to sealing coupler 32 and inserted in cabinet 20. As shown in FIG. 4, to remove $CO_2$ cylinder 29 and portable tank 27, portable tank 27 is first pulled out of the cabinet in the direction of arrow H, and then $CO_2$ cylinder 29 is removed in the direction of arrow G. Portable tank 27 includes handle 27*a* for easy grasping when tank 27 is removed and replaced.

Figure 8:
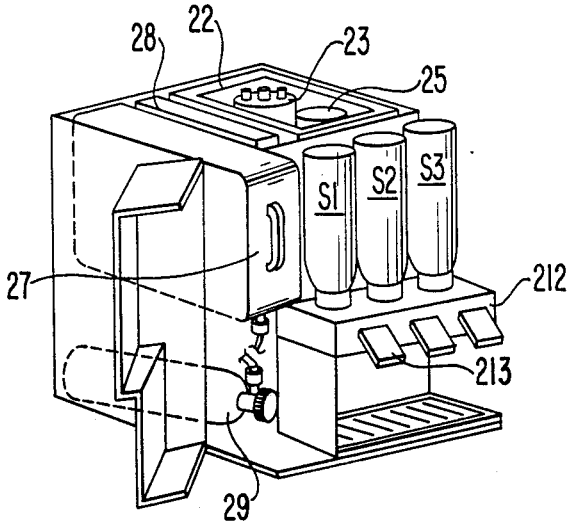
FIG. 8 is a front perspective view of a portable post-mix beverage dispenser unit in accordance with a second embodiment of this invention having the front access panel and an additional panel removed to illustrate the compartments for the portable tank and syrup supply.
Figure 9:
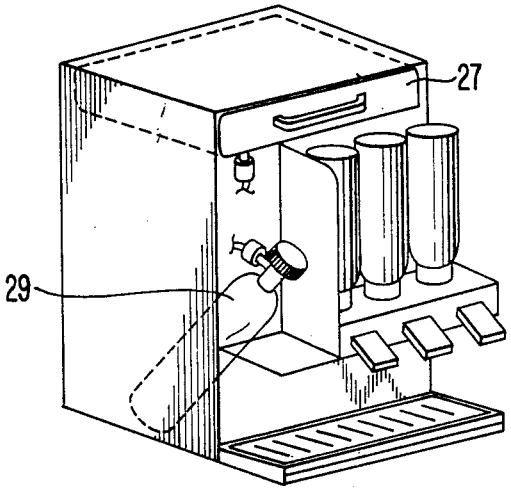
FIG. 9 is a front perspective view of a portable post-mix beverage dispenser unit in accordance with a third embodiment of the invention having the front access panel removed to illustrate the compartments for the portable tank and the syrup supply.

With reference to FIG. 8, a portable post-mix beverage dispenser in accordance with a second embodiment of the invention is shown. In FIG. 8, $CO_2$ cylinder 29 is disposed horizontally beneath portable tank 27 for ease of operation. Additionally, with reference to FIG. 9, a construction of a dispenser in accordance with the third embodiment of the invention is shown. In FIG. 9, $CO_2$ cylinder 29 is disposed beneath portable tank 27 at an inclined angle and portable tank 27 is disposed horizontally across the top of cabinet 20.

This invention has been described in connection with the preferred embodiments. The preferred embodiments, however, are merely for example only and the invention is not restructed thereto. It can be easily understood by those skilled in the art that variations and modifications can be easily made within the scope of the invention as defined by the appended claims.

We claim:

1. A post-mix beverage dispensing system comprising:

a cabinet housing having an openable top access panel, an openable front access panel defining a region in which a plurality of syrup packages are accommodated side by side, and an additional panel disposed adjacent said front access panel, said additional panel being forwardly openable;

a detachable portable tank means for storing potable water, said portable tank means disposed behind said additional panel and removable from said housing by sliding forwardly therefrom when said additional panel is opened;

cooling reservoir means for cooling potable water supplied from said portable tank means, said cooling reservoir disposed within said cabinet at a position behind said syrup packages;

carbonator means disposed in said cooling reservoir for producing carbonated water by mixing cooled water from said portable tank means with $CO_2$;

$CO_2$ tank means for supplying $CO_2$ to said carbonator means, said $CO_2$ tank means vertically disposed between said portable tank means and said cooling reservoir means;

first pipe means partially disposed in said cooling reservoir means for linking said portable tank means to said carbonator means;

second pipe means for linking said $CO_2$ tank means with said carbonator means;

valve means for controlling the flow of carbonated water from said carbonator means; and third pipe means linking said carbonator means with said valve means.

2. The post-mix beverage dispensing system recited in claim 1, further comprising fourth pipe means linking said second pipe means to said syrup package means for supplying $CO_2$ from said $CO_2$ tank means to said syrup package means to supply syrup from said syrup package means to said valve means.

3. The post-mix beverage dispensing system recited in claim 2, further comprising fifth pipe means linked to said first pipe means through a three-way electromagnetic valve at one end and linked to said valve means at its other end, said fifth pipe means for supplying cooled potable water from said portable tank means to said valve means, said valve means mixing and dispensing said carbonated water, said syrup and said cooled potable water.

4. The post-mix beverage dispensing system recited in claim 1, said carbonator means storing carbonated water produced therein, said system further comprising sensing means disposed in said carbonator means for sensing the level of carbonated water stored in said carbonator means.

5. The post-mix beverage dispensing system recited in claim 4, further comprising pump means disposed in said first pipe means between said portable tank means and said carbonator means for pumping potable water from said portable tank means to said carbonator means.

6. The post-mix beverage dispensing system recited in claim 1, further comprising fourth pipe means linked to said first pipe means through a three-way electromagnetic valve at one end, and linded to said valve means at its other end, said fourth pipe means for supplying cooled potable water from said portable tank means to said valve means.

7. The post-mix beverage dispensing system recited in claim 1, said first pipe means including a serpentine portion disposed in said cooling reservoir means for quickly cooling potable water from said portable tank means.

8. The post-mix beverage dispensing system recited in claim 1, further comprising sealing coupler means disposed between said portable tank means and said carbonator means for allowing said portable tank means to be detached without leaking water.

9. The post-mix beverage dispensing system recited in claim 1, said portable tank means including a handle means on a front face thereof for grasping said portable tank means when said portable tank means is removed from and replaced in said cabinet housing.

* * * * *